US008172615B2

(12) United States Patent
Mason

(10) Patent No.: US 8,172,615 B2
(45) Date of Patent: May 8, 2012

(54) ELECTRICAL CONNECTOR FOR AN ELECTRONIC MODULE

(75) Inventor: Jeffery Walter Mason, North Attleboro, MA (US)

(73) Assignee: Tyco Electronics Corporation, Berwy, PA (US)

( * ) Notice: Subject to any disclaimer, the term of this patent is extended or adjusted under 35 U.S.C. 154(b) by 0 days.

(21) Appl. No.: 13/021,332

(22) Filed: Feb. 4, 2011

(65) Prior Publication Data

US 2012/0003871 A1 Jan. 5, 2012

Related U.S. Application Data

(63) Continuation-in-part of application No. 12/827,602, filed on Jun. 30, 2010.

(51) Int. Cl.
*H01R 13/648* (2006.01)

(52) U.S. Cl. ..... 439/607.08; 439/108

(58) Field of Classification Search ..... 439/607.01, 439/607.05, 607.12, 607.08, 108
See application file for complete search history.

(56) References Cited

U.S. PATENT DOCUMENTS 5,211,567 A * 5/1993 Neumann et al. ..... 439/74
5,772,451 A 6/1998 Dozier, II et al.
5,906,511 A * 5/1999 Bozzer et al. ..... 439/579
5,917,707 A 6/1999 Khandros et al.
6,533,613 B1 * 3/2003 Turner et al. ..... 439/607.05
6,764,341 B2 * 7/2004 Lappoehn ..... 439/607.05
7,114,961 B2 10/2006 Williams
7,371,073 B2 5/2008 Williams
2010/0304610 A1 * 12/2010 Tanaka et al. ..... 439/607.01

* cited by examiner

*Primary Examiner* — Gary F. Paumen

(57) ABSTRACT

An electrical connector is provided for electrically connecting an electronic module to an electrical component. The electrical connector includes an insulator having a module side and an opposite component side. The insulator is configured to extend between the electronic module and the electrical component such that the module side faces the electronic module and the component side faces the electrical component. Electrical contacts are held by the insulator. The electrical contacts include mating segments arranged in an array along the module side of the insulator. The mating segments are configured to mate with mating contacts of the electronic module. The electrical connector further includes a shield having a body that is at least partially electrically conductive. The body of the shield is mounted on the insulator such that the body covers at least a portion of the module side of the insulator. The body of the shield includes an opening defined by at least one interior wall of the body. The opening receives the mating segment of at least one of the electrical contacts therein such that the at least one interior wall extends at least partially around the mating segment of the at least one electrical contact.

21 Claims, 10 Drawing Sheets

ELECTRICAL CONNECTOR FOR AN ELECTRONIC MODULE

CROSS-REFERENCE TO RELATED APPLICATIONS

This application is a continuation-in-part of U.S. application Ser. No. 12/827,602, entitled "Electrical Connector For An Electronic Module," and filed on Jun. 30, 2010. The disclosure of the above listed application is incorporated by reference herein in its entirety.

BACKGROUND OF THE INVENTION

The subject matter described and/or illustrated herein relates generally to electrical connectors, and more specifically, to electrical connectors for electronic modules.

Competition and market demands have continued the trend toward smaller and higher performance (e.g., faster) electrical systems. The resulting higher density electrical systems have led to the development of surface mount technology. Surface mount technology allows an electronic module to be electrically connected to contact pads on the surface of an electrical component, such as a printed circuit (sometimes referred to as a "circuit board" or a "printed circuit board"). The electronic module is connected to the electrical component either directly or through an intervening electrical connector, rather than using conductive vias that extend within the electrical component. Surface mount technology allows for an increased component density on the electrical component, which enables the development of smaller and higher performance systems.

Examples of electrical connectors for such smaller and higher performance electrical systems include land-grid array (LGA) sockets and ball-grid array (BGA) sockets. LGA sockets include an array of electrical contacts that are electrically connected to the electrical component and engage an array of contact pads on the electronic module. BGA sockets also include an array of electrical contacts that are electrically connected to the electrical component, but instead of contact pads the electrical contacts of BGA sockets engage an array of solder balls on the electronic module. The electrical contacts of both LGA sockets and BGA sockets may engage contact pads on the electrical component or may be electrically connected to the electrical component via an array of solder balls.

The electrical contacts of electrical connectors used to electrically connect an electronic module to an electrical component typically include both ground and signal contacts. The ground contacts are positioned within the array such that individual or differential pairs of the signal contacts are surrounded by ground contacts. The ground contacts thereby shield the individual or signal contact pairs from neighboring signal contacts or signal contact pairs. However, to provide adequate shielding between neighboring signal contacts or signal contact pairs, each signal contact or signal contact pair is typically surrounded by a plurality of ground contacts such that a ground contact extends between the signal contact or signal contact pair and each neighboring signal contact or signal contact pair. The ground contacts occupy space within the array that could otherwise be occupied by signal contacts. In other words, the number of ground contacts may limit the number of signal contacts provided within a connector having a given size and/or within an array having a given number of electrical contacts overall. Moreover, the number of ground contacts may limit the density of signal contacts provided within a connector having a given size and/or within an array having a given number of electrical contacts overall. Accordingly, surrounding individual signal contacts or signal contact pairs with a plurality of ground contacts may limit the development of smaller and higher performance electrical connectors. Additionally, surrounding individual signal contacts or signal contact pairs with a plurality of ground contacts may limit the relative arrangement of signal contacts, ground contacts, and/or signal contact pairs within the array, which may limit a designer's ability to select an arrangement that provides a desired performance of the electrical connector.

BRIEF DESCRIPTION OF THE INVENTION

In one embodiment, an electrical connector is provided for electrically connecting an electronic module to an electrical component. The electrical connector includes an insulator having a module side and an opposite component side. The insulator is configured to extend between the electronic module and the electrical component such that the module side faces the electronic module and the component side faces the electrical component. Electrical contacts are held by the insulator. The electrical contacts include mating segments arranged in an array along the module side of the insulator. The mating segments are configured to mate with mating contacts of the electronic module. The electrical connector further includes a shield having a body that is at least partially electrically conductive. The body of the shield is mounted on the insulator such that the body covers at least a portion of the module side of the insulator. The body of the shield includes an opening defined by at least one interior wall of the body. The opening receives the mating segment of at least one of the electrical contacts therein such that the at least one interior wall extends at least partially around the mating segment of the at least one electrical contact.

In another embodiment, an electrical connector is provided for electrically connecting an electronic module to an electrical component. The electrical connector includes an insulator having a module side and a component side that is opposite the module side. Electrical contacts are held by the insulator. The electrical contacts include mating segments arranged in an array along the module side of the insulator. The mating segments are configured to mate with mating contacts of the electronic module. The electrical contacts include a ground contact. The electrical connector also includes a shield having a body that is at least partially electrically conductive. The body of the shield is mounted on the insulator such that the body extends at least partially around the mating segment of at least one of the electrical contacts. The body of the shield is engaged with the ground contact to electrically connect the body to the ground contact.

In another embodiment, an electronic assembly includes an electronic module having an array of mating contacts. The electronic assembly also includes an electrical component and an electrical connector extending between and electrically connecting the electronic module to the electrical component. The electrical connector includes an insulator having a module side and an opposite component side. The module side faces the electronic module and the component side faces the electrical component. The electrical connector is electrically connected to the electrical component along the component side of the insulator. Electrical contacts are held by the insulator. The electrical contacts include mating segments arranged in an array along the module side of the insulator. The mating segments are mated with the mating contacts of the electronic module. The electrical connector also includes a shield having a body that is at least partially electrically conductive. The body of the shield is mounted on the insulator such that the body extends at least partially around the mating segment of at least one of the electrical contacts.

DETAILED DESCRIPTION OF THE INVENTION

Figure 1:
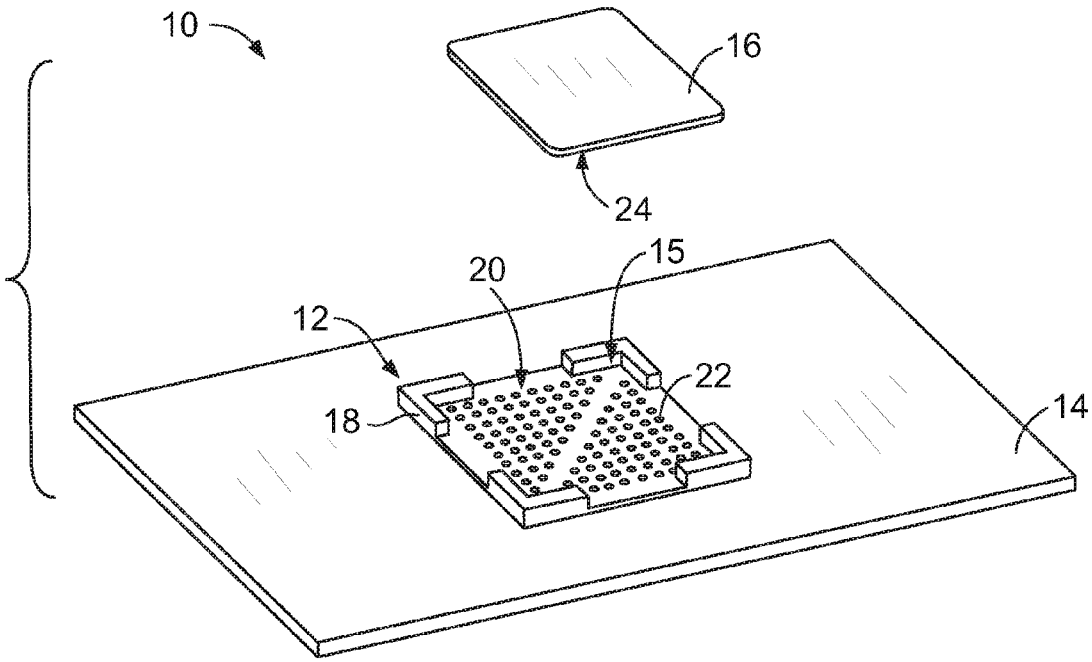
FIG. 1 is a partially exploded perspective view of an exemplary embodiment of an electrical system.

FIG. 1 is a partially exploded perspective view of an exemplary embodiment of an electronic assembly 10. The electronic assembly 10 includes an electrical connector 12, a printed circuit 14, and an electronic module 16. The electrical connector 12 is mounted on the printed circuit 14. The electronic module 16 is loaded onto the electrical connector 12 to electrically connect the electronic module 16 to the printed circuit 14 via the electrical connector 12. Optionally, the electrical connector 12 is a socket connector. For example, the electrical connector 12 optionally includes a socket 15 that is configured to receive at least a portion of the electronic module 16 therein. The electronic module 16 may be any type of electronic module, such as, but not limited to, a chip, a package, a central processing unit (CPU), a processor, a memory, a microprocessor, an integrated circuit, a printed circuit, an application specific integrated circuit (ASIC), and/or the like.

The electrical connector 12 includes a dielectric alignment frame 18 that is mounted on the printed circuit 14. The alignment frame 18 holds an interconnect member 20 that includes an array of electrical contacts 22. The electronic module 16 has a mating side 24 along which the electronic module 16 mates with the interconnect member 20. The interconnect member 20 is interposed between contact pads (not shown) on the mating side 24 of the electronic module 16 and corresponding contact pads (not shown) on the printed circuit 14 to electrically connect the electronic module 16 to the printed circuit 14.

In the exemplary embodiment, the electrical connector 12 is a land grid array (LGA) connector. However, it is to be understood that the subject matter described and/or illustrated herein is also applicable to other connectors, connector assemblies, and/or the like, such as, but not limited to, ball grid array (BGA) connectors and/or the like. Moreover, while the electrical connector 12 is described and illustrated herein as interconnecting the electronic module 16 with a printed circuit 14, it should be understood that other electrical components may be interconnected with the electronic module 16 via the electrical connector 12, such as, but not limited to, a chip, a package, a central processing unit (CPU), a processor, a memory, a microprocessor, an integrated circuit, an application specific integrated circuit (ASIC), and/or the like. Furthermore, the electrical connector 12 is not limited to the number or type of parts shown in FIG. 1, but rather may include and/or operate in conjunction with additional parts, components, and/or the like that are not shown or described herein. Thus, the following description and the drawings are provided for purposes of illustration, rather than limitation, and is but one potential application of the subject matter described and/or illustrated herein.

Figure 2:
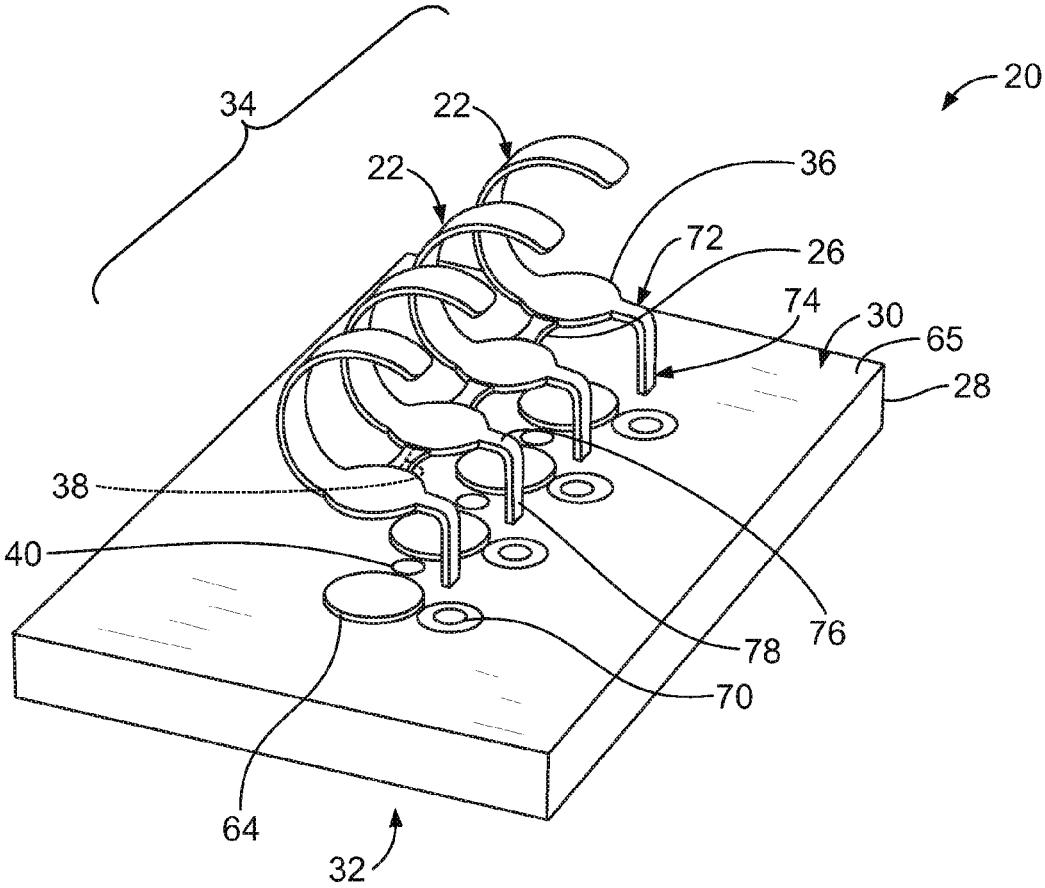
FIG. 2 is an exploded perspective view of a portion of an exemplary embodiment of an interconnect member of the electrical system shown in FIG. 1.

FIG. 2 is an exploded perspective view of a portion of an exemplary embodiment of the interconnect member 20 illustrating the interconnect member 20 before connection strips 26 that interconnect adjacent electrical contacts 22 have been broken. The interconnect member 20 includes an insulator 28 that holds the electrical contacts 22. The insulator 28 includes a module side 30 and an opposite component side 32. FIG. 2 illustrates a portion of a row 34 of the electrical contacts 22. The electrical contacts 22 are mounted on the module side 30 of the insulator 28 for engagement with the contact pads (not shown) on the mating side 24 (FIG. 1) of the electronic module 16 (FIG. 1). The electrical contacts 22 are fabricated from the same sheet or reel of material (not shown). The electrical contacts 22 may be fabricated from the sheet or reel using any process, such as, but not limited to, stamping, cutting, machining, etching, forming, casting, molding and/or the like. Each of the electrical contacts 22 may be referred to herein as a "first" and/or a "second" electrical contact.

The electrical contacts 22 include mounting bases 36. After being fabricated from the sheet or reel, adjacent electrical contacts 22 within the row 34 are mechanically and electrically connected together via the connection strips 26. Each connection strip 26 extends along a connection path 38 that extends from the mounting base 36 of one of the electrical contacts 22 to the mounting base 36 of an adjacent electrical contact 22. As will be described below, the connection strips 26 are configured to be broken along the connection paths 38 to mechanically and electrically separate the electrical contacts 22 from each other. Punch openings 40 are provided within the module side 30 of the insulator 28 to enable the connection strips 26 to be broken using a punch 42 (FIG. 5) after the electrical contacts 22 are mechanically connected to the insulator 28. In the exemplary embodiment, the connection path 38 between each pair of adjacent electrical contacts 22 is linear. However, one or more of the connection paths 38 may alternatively include one or more bends, curves, angles, and/or the like such that the connection path 38 is non-linear. The connection path 38 of each connection strip 26 may include any other shape.

Figure 11:
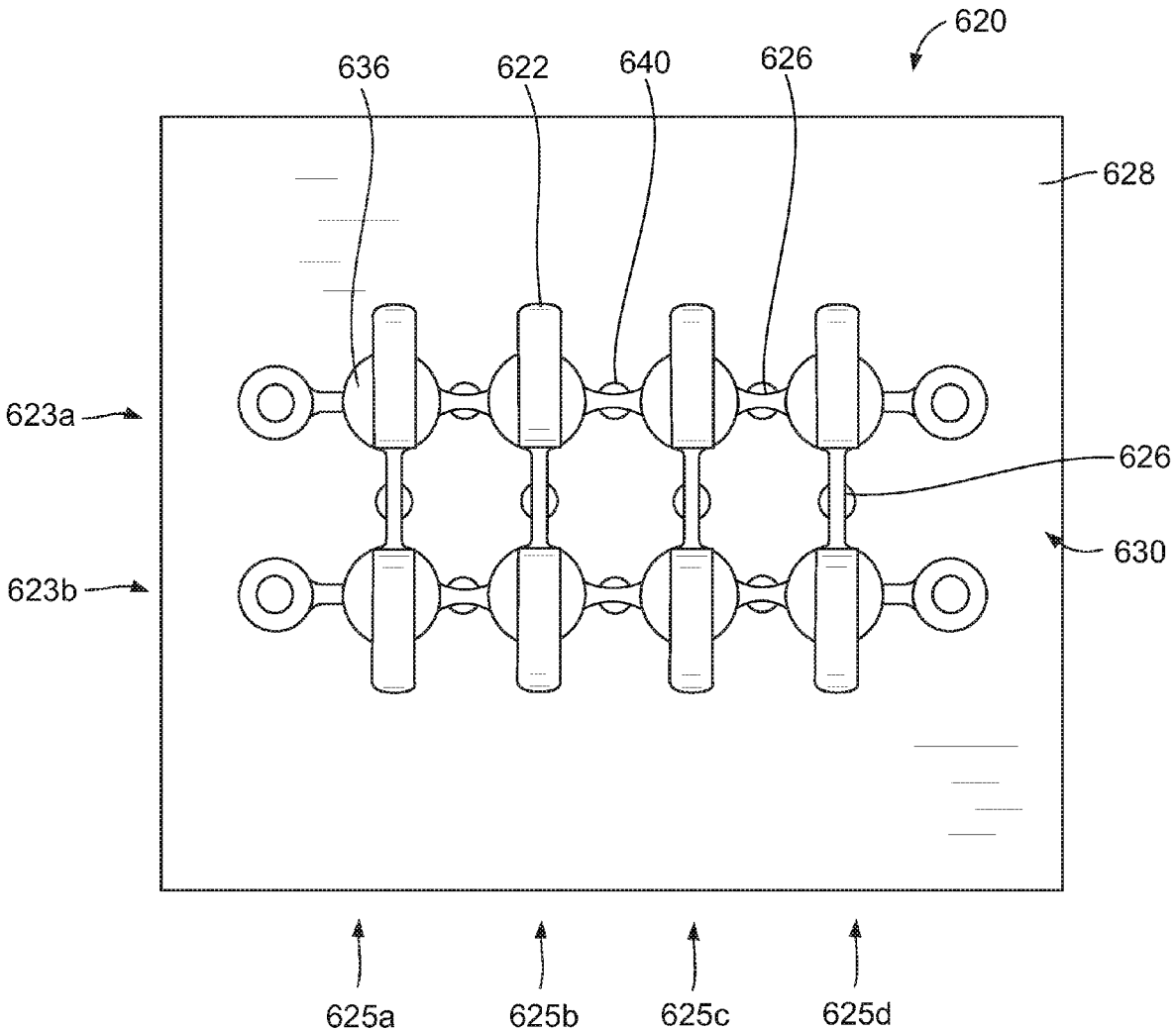
FIG. 11 is a top plan view of a portion of another exemplary alternative embodiment of an interconnect member.

Although FIG. 2 illustrates a portion of the row 34 of the electrical contacts 22, it should be understood that only a portion of the array of electrical contacts 22 is shown in FIG. 2. In other words, only some of the electrical contacts 22 of the interconnect member 20 are shown in FIG. 2. The row 34 may include other electrical contacts 22 that are not shown and the array of electrical contacts 22 may include other rows and/or columns. For example, FIG. 11 is a top plan view of a portion of an exemplary alternative embodiment of an interconnect member 620. The interconnect member 620 includes an insulator 628 having a module side 630, and an array of electrical contacts 622 having mounting bases 636 that are mechanically connected to the insulator 628 on the module side 630. The portion of the array of electrical contacts 622 shown in FIG. 11 includes electrical contacts 622 that are arranged in two rows 623*a* and 623*b* and four columns 625*a*, 625*b*, 625*c*, and 625*d*. The mounting bases 636 of adjacent electrical contacts 622 within each row 623*a* and 623*b* are initially connected together via corresponding connection strips 626. Similarly, the mounting bases 636 of adjacent electrical contacts 622 within each column 625*a-d* are initially connected together via corresponding connection strips 626. Punch openings 640 are formed in the module side 630 of the insulator 628 and aligned with the connection strips 626. Each of the electrical contacts 622 may be referred to herein as a "first" and/or a "second" electrical contact.

In an alternative embodiment, one or more of the electrical contacts 622 within the row 623*a* is not initially connected to one or more adjacent electrical contacts 622 within the row 623*a* via a connection strip 626, and/or one or more of the electrical contacts 622 within the row 623*b* is not initially connected to one or more adjacent electrical contacts 622 within the row 623*b* via a connection strip 626. Similarly, in an alternative embodiment, one or more of the electrical contacts 622 within the column 625*a*, 625*b*, 625*c*, and/or 625*d* is not initially connected to one or more adjacent electrical contacts 622 within the same column 625*a*, 625*b*, 625*c*, and/or 625*d* via a connection strip 626.

Referring again to FIG. 2, the array of electrical contacts 22 may have any number of electrical contacts 22 overall and the contacts 22 may be arranged in any pattern having any number of rows and columns. Although all of the electrical contacts 22 shown in FIG. 2 (as well as, for example, the electrical contacts 622 shown in FIG. 11) are initially connected to adjacent electrical contacts 22 via the connection strips 26, it should be understood that the array of electrical contacts 22 may or may not include individual groups (e.g., rows, columns, other shaped patterns, and/or the like) of interconnected electrical contacts 22 that are not initially connected to the electrical contacts 22 of one or more other groups via connection strips. For example, in an alternative embodiment to the interconnect member 620 shown in FIG. 11, none of the electrical contacts 622 within the row 623*a* are initially connected to adjacent electrical contacts 622 within the row 623*b* via a connection strip. Each electrical contact 622 may be initially connected to only some or to all electrical contacts 622 that are adjacent thereto.

Figure 3:
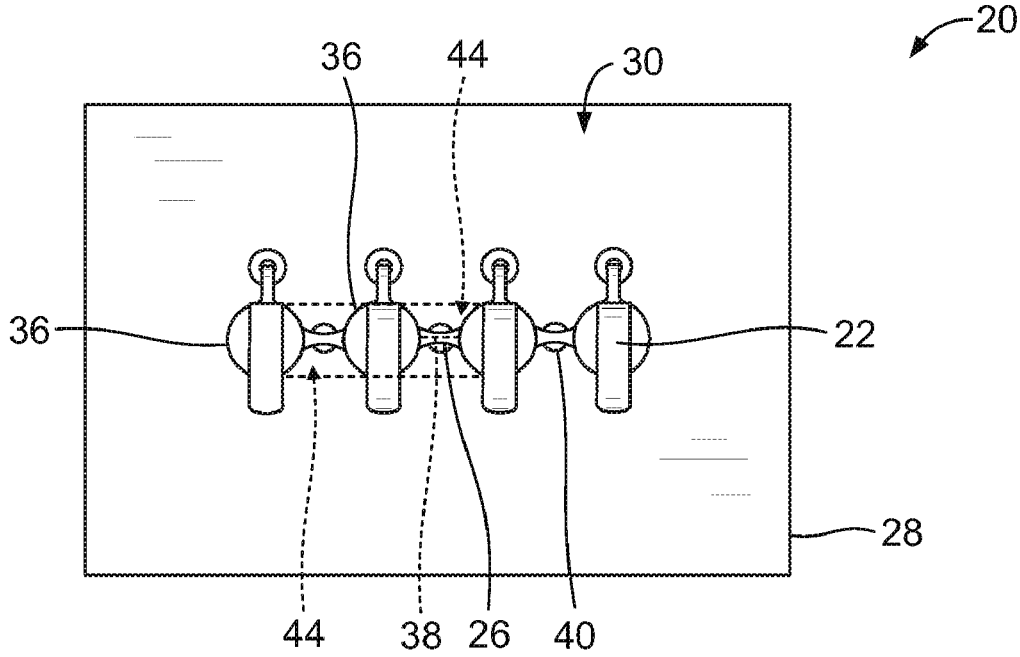
FIG. 3 is a top plan view of the portion of the interconnect member shown in FIG. 2.

FIG. 3 is a top plan view of the portion of the interconnect member 20 shown in FIG. 2 illustrating an exemplary embodiment of the module side 30 of the insulator 28. The electrical contacts 22 are shown in FIG. 3 mechanically connected to the insulator 28 on the module side 30. Each punch opening 40 is positioned along the module side 30 of the insulator 28 in alignment with the connection path 38 of a corresponding connection strip 26. In other words, the punch openings 40 are aligned with the corresponding connection strips 26. In the exemplary embodiment, the punch openings 40 are positioned along the module side 30 of the insulator 28 between the mounting bases 36 of adjacent electrical contacts 22. Optionally, a straight line drawn from the center of one mounting base 36 to the center of an adjacent mounting base 36 intersects a corresponding punch opening 40.

The exemplary position of the punch openings 40 between the mounting bases 36 is a result of the exemplary connection paths 38 that extend entirely between the mounting bases 36. As used herein, "between" the mounting bases 36 is intended to mean an area 44 that is bounded by the dashed lines in FIG. 3, which extend from the peripheries of one of the mounting bases 36 to the peripheries of the adjacent mounting base 36. In embodiments wherein a connection strip 26 extends along a connection path 38 that extends at least partially outside the area 44, the corresponding punch opening 40 may be positioned outside of the area 44, so long as the corresponding punch opening 40 is aligned with the connection path 38 somewhere therealong.

Figure 4:
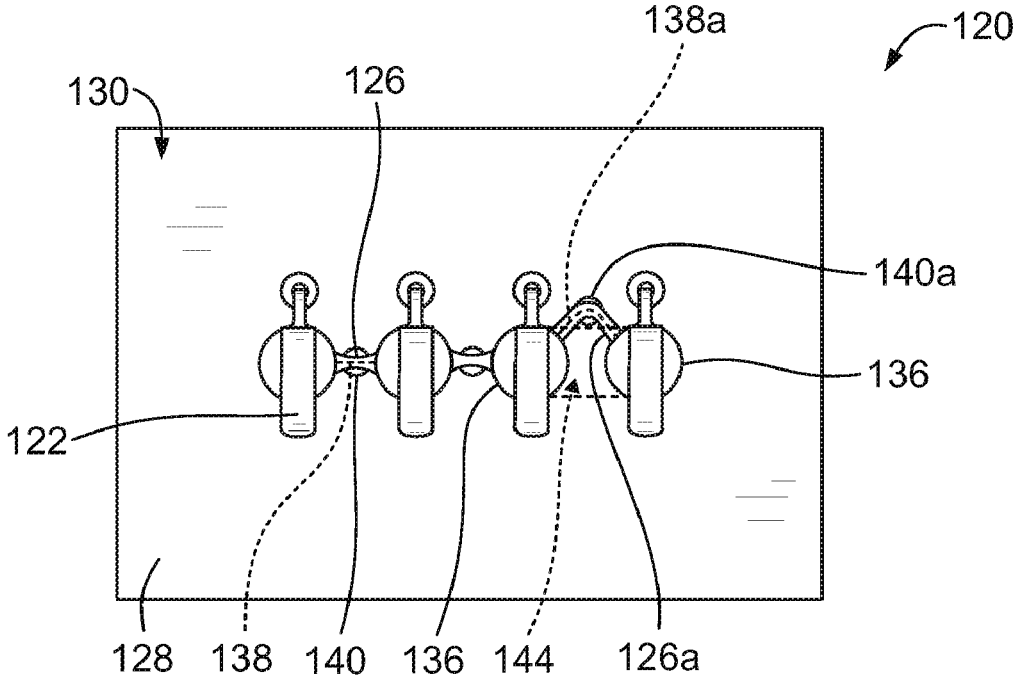
FIG. 4 is a top plan view of a portion of an exemplary alternative embodiment of an interconnect member.

For example, FIG. 4 illustrates a portion of an alternative embodiment of an interconnect member 120 wherein the connection path 138*a* of one of the connection strips 126*a* extends outside of an area 144 between the corresponding adjacent mounting bases 136. The interconnect member 120 includes an insulator 128 having a module side 130, and electrical contacts 122 having mounting bases 136 mechanically connected to the insulator 128 on the module side 130. The mounting bases 136 of adjacent electrical contacts 122 are connected together via corresponding connection strips 126 that extend along connection paths 138. Punch openings 140 are formed in the module side 130 and aligned with the connection strips 126. The connection path 138*a* of one of the connection strips 126*a* extends outside of an area 144 between the corresponding adjacent mounting bases 136. The corresponding punch opening 140*a* is positioned along the module side 130 of the insulator 128 outside of the area 144 between the corresponding mounting bases 136. The punch opening 140*a* is aligned with the connection path 138*a* outside of the area 144.

Figure 5:
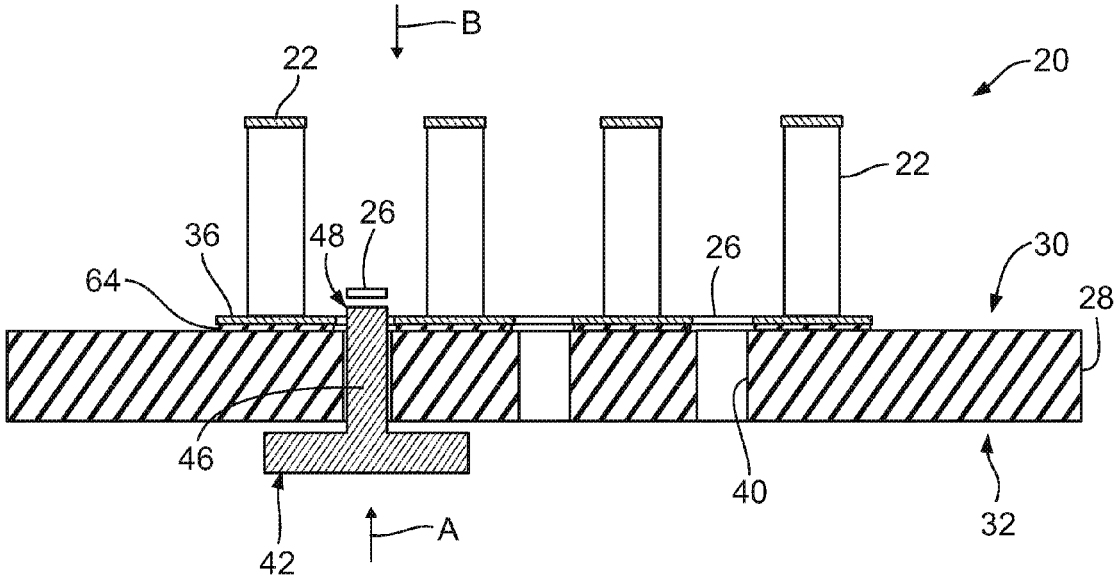
FIG. 5 is a cross-sectional view of the portion of the interconnect member shown in FIGS. 2 and 3.

FIG. 5 is a cross-sectional view of the portion of the interconnect member 20 shown in FIGS. 2 and 3. In the exemplary embodiment, the punch openings 40 extend completely through the insulator 28. In other words, each punch opening 40 extends through both of the module and component sides 30 and 32, respectively, and completely through the insulator 28 between the sides 30 and 32. As can be seen in FIG. 5, the connection strips 26 extending along the module side 30 of the insulator 28 are exposed to the component side 32 through the punch openings 40. Exposure of the connection strips 26 along the component side 32 of the insulator 28 enables the connection strips 26 to be broken from the component side 32. In an alternative embodiment, one or more of the punch openings 40 does not extend completely through the insulator 28. For example, one or more of the punch openings 40 may alternatively extend through the module side 30 and through only a portion of the insulator 28 between the sides 30 and 32, such that the punch opening 40 does not extend through the component side 32. As will be described below, the connection strips 26 may be broken using the punch 42 (FIG. 5) from either the component side 32 or the module side 30.

The electrical contacts 22 are illustrated in FIG. 5 as mounted on the insulator 28. More particularly, the mounting bases 36 of the electrical contacts 22 are mechanically connected to the insulator 28 on the module side 30. The mounting of the electrical contacts 22 on the insulator 28 will be described below. As shown in FIG. 5 and described above with reference to FIG. 2, the mounting bases 36 of the electrical contacts 22 are initially mechanically and electrically connected together by the connection strips 26. After the electrical contacts 22 have been mechanically connected to the insulator 28, the electrical contacts 22 can be separated from each other by breaking the connection strips 26.

In the exemplary embodiment, the punch 42 is used to break the connection strips 26. The punch 42 includes a punch tool 46 having an end 48 that is configured to engage a connection strip 26. The end 48 of the punch tool 46 is configured to sever, or break, the connection strip 26 when sufficient force is applied to the punch 42. Although shown as including an approximately planar surface, the end 48 of the punch tool 46 may additionally or alternatively include any other shape (e.g., a point, a round, a tip, a cutting edge, and/or the like) that enables the punch tool 46 to break the connection strip 26. In the exemplary embodiment, the approximately planar surface of the end 48 of the punch tool 46 enables the punch tool 46 to break the connection strip 26. Optionally, the punch 42 includes more than one punch tool 46 for simultaneously breaking more than one connection strip 26. The punch 42 may include any number of the punch tools 46 for simultaneously breaking any number of connection strips 26.

Figure 6:
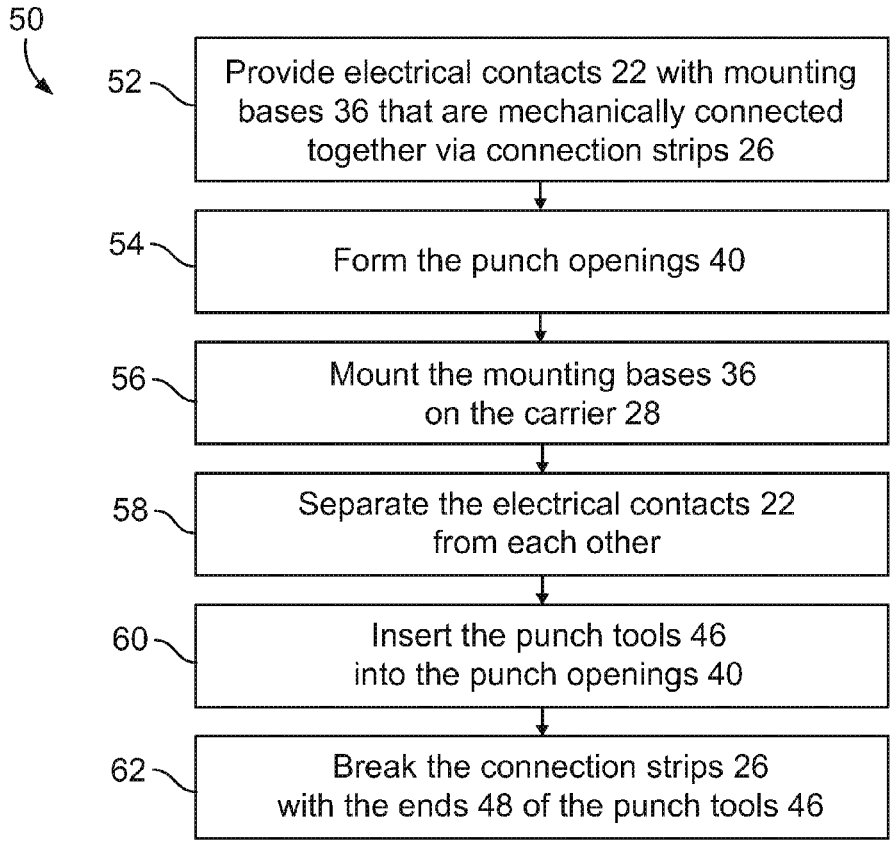
FIG. 6 is a flow chart illustrating an exemplary embodiment of a method for fabricating the interconnect member shown in FIGS. 2, 3, and 5.

FIG. 6 is a flow chart illustrating an exemplary embodiment of a method 50 for fabricating the electrical connector 12. More particularly, the method 50 is used to fabricate the interconnect member 20. Unless otherwise indicated, the steps of the method 50 may be performed in any order, including steps labeled with a reference numeral and steps that are not labeled with a reference numeral. Referring now to FIGS. 5 and 6, the method 50 includes providing 52 the electrical contacts 22 with the mounting bases 36 that are mechanically connected together via the connection strips 26. The method 50 also includes forming 54 the punch openings 40. The mounting bases 36 of the electrical contacts 22 are mounted 56 on the insulator 28. More particularly, the mounting bases 36 are mechanically connected to the insulator 28. Optionally, mounting 56 the mounting bases 36 on the insulator 28 includes soldering the mounting bases 36 to corresponding solder pads 64 of the insulator 28.

After the mounting bases 36 of the electrical contacts 22 have been mounted 56 on the insulator 28, the electrical contacts 22 are separated 58 from each other by breaking the connection strips 26. In the exemplary embodiment, the electrical contacts 22 are separated 58 from each other after the mounting bases 36 have been soldered to the solder pads 64 of the insulator 28. Separating 58 the electrical contacts 22 from each other includes inserting 60 the punch tool 46 into the punch openings 40. The end 48 of the punch tool 46 is engaged with the corresponding connection strip 26. Force is applied to the punch 42 in the direction of the arrow A until the connection strip 26 is broken 62 by the end 48 of the punch tool 46, as shown in FIG. 5. In the exemplary embodiment, the punch tool 46 is inserted through the punch opening 40 from the component side 32 of the insulator 28. Separating 58 the electrical contacts 22 from each other thus includes inserting the punch tool 46 through the punch openings 40 from the component side 32 and breaking the connection strips 26 along the module side 30 of the insulator 28. The exemplary embodiment of the punch openings 40 enable the connection strips 26 to be broken from the component side 32 (i.e., using the punch 42 on the component side 32).

The connection strips 26 may alternatively be broken from the module side 30 of the insulator 28. Specifically, the punch 42 is positioned along the module side 30 of the insulator 28 and the end 48 of the punch tool 46 is engaged with the connection strip 26. Force is applied to the punch 42 in the direction of the arrow B until the connection strip 26 is broken 62 by the end 48 of the punch tool 46. After breaking the connection strip 26, the end 48 of the punch tool 46 is received into the corresponding punch opening 40. The punch openings 40 therefore provide accommodation for the end 48 of the punch tool 46, which would otherwise be forced into engagement with the insulator 28 and thereby possibly damage the insulator 28 and/or the punch 42. In another alternative embodiment, one or more of the connection strips 26 is broken using a punch from the component side 32, while one or more other connection strips 26 is broken using another punch (or the same punch at a different time) from the module side 30.

In an alternative embodiment, the connection strips 26 are broken after the electrical contacts 22 are mechanically connected to the insulator 28 using any other process. For example, the connection strips 26 may alternatively be broken by cutting the connection strips 26 with a laser and/or other cutting tool (not shown), by chemically etching the connection strips 26, and/or the like.

Figure 7:
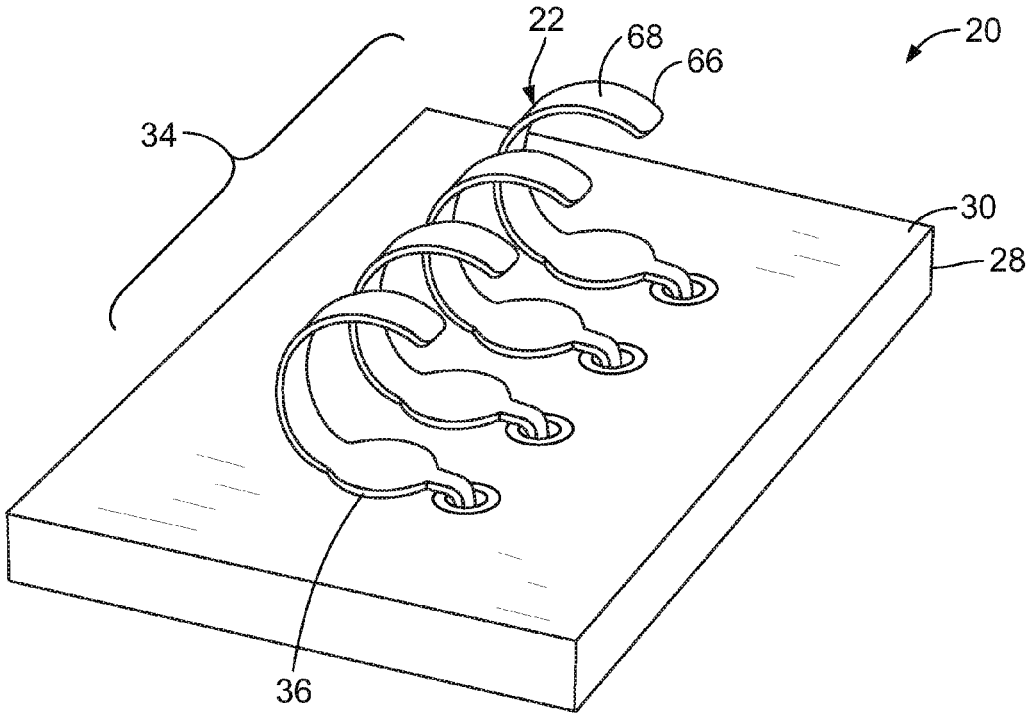
FIG. 7 is a perspective view of the portion of the interconnect member shown in FIGS. 2 and 3 illustrating electrical contacts of the interconnect member after the electrical contacts have been separated from each other.

FIG. 7 is a perspective view of the portion of the interconnect member 20 shown in FIGS. 2 and 3 illustrating the electrical contacts 22 after separation 58 (FIG. 6) of the electrical contacts 22 from each other. The electrical contacts 22 are mounted on the module side 30 of the insulator 28. The connection strips 26 (FIGS. 2, 3, and 5) have been broken and removed such that the mounting bases 36 of the electrical contacts 22 are no longer mechanically and electrically connected together. Accordingly, the electrical contacts 22 within the row 34 are electrically isolated from each other.

Each electrical contact 22 includes a mating segment 66 that extends outwardly from the mounting base 36. The mating segments 66 include mating interfaces 68 that are configured to engage the corresponding contact pads (not shown) on the mating side 24 (FIG. 1) of the electronic module 16 (FIG. 1) to electrically connect the electrical contacts 22 to the electronic module 16. Optionally, the mating segments 66 are resiliently deflectable springs that are configured to deflect toward the insulator 28 when engaged with the contact pads of the electronic module 16. In addition or alternative to being resiliently deflectable springs, an elastomeric column (not shown) is optionally disposed between the mounting base 36 and the mating segment 66 of one or more of the electrical contacts 22. The mating segments 66 are shown herein including a curved shape that curls back over the mounting bases 36. But, the mating segments 66 may additionally or alternatively include any other shape.

Figure 8:
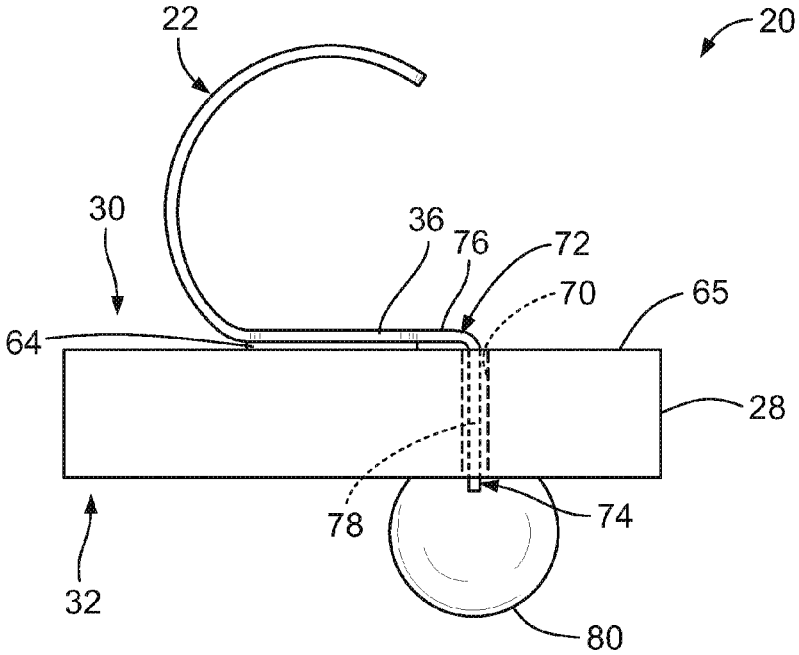
FIG. 8 is a side elevational view of the portion of the interconnect member shown in FIG. 7 illustrating a solderball for directly mounting to a printed circuit.

FIG. 8 is a side-elevational view of the portion of the interconnect member 20 shown in FIG. 7. Referring now to FIGS. 2 and 8, in the exemplary embodiment, the insulator 28 includes the solder pads 64 for mounting the electrical contacts 22 on the insulator 28. The mounting bases 36 of the electrical contacts 22 are soldered to the corresponding solder pads 64 to mechanically connect the mounting bases 36, and thus the electrical contacts 22, to the module side 30 of the insulator 28. In addition or alternatively to being soldered, the mounting bases 36 are mechanically connected to the solder pads 64 and/or other structures on the module side 30 of the insulator 28 using an adhesive, using a press-fit connection, using a snap-fit connection, and/or using another type of mechanical fastener, connection, and/or the like. Moreover, in alternative to the solder pads 64, the mounting bases 36 may be mechanically connected directly to a surface 65 of the insulator 28 that defines the module side 30.

Alignment holes 70 extend into the module side 30 of the insulator 28. The alignment holes 70 are positioned proximate corresponding ones of the solder pads 64. The electrical contacts 22 include alignment tails 72 that extend outwardly from the mounting bases 36. Each alignment tail 72 is received within the corresponding alignment hole 70. Reception of the alignment tails 72 within the alignment holes 70 positions (i.e., locates and orients) the mounting bases 36 relative to the solder pads 64. In other words, the alignment holes 70 and the alignment tails 72 cooperate to provide the electrical contacts 22 with the proper location and orientation on the module side 30 of the insulator 28.

The alignment tails 72 extend outwardly from the mounting bases 36 to tips 74. Each alignment tail 70 includes a module side segment 76 that extends outwardly from the mounting base 36 and a hole segment 78 that extends from the module side segment 76 and includes the tip 74. The module side segment 76 extends along the module side 30 of the insulator 28. The hole segment 78 extends outwardly from the module side segment 76 and into the corresponding alignment hole 70. The tip 74 of each alignment tail 72 is engaged with a corresponding solder ball 80 (not visible in FIG. 2) on the component side 32 of the insulator 28. The alignment tails 72 electrically connect the electrical contacts 22 on the module side 30 of the insulator 28 to the solder balls 80 on the component side 32 of the insulator 28. The solder balls 80 are configured to engage the corresponding contact pads (not shown) on the printed circuit 14 (FIG. 1) to electrically connect the electrical contacts 22 to the printed circuit 14.

Optionally, the alignment tails 72 are engaged with the insulator 28 within the alignment holes 70. For example, the hole segments 78 of the alignment tails 72 may be received within the alignment holes 70 with an interference fit. Additionally or alternatively, the hole segments 78 may include barbs (not shown) that engage the insulator 28 within the alignment holes 70. The alignment holes 70 are optionally tapered inwardly as they extend into the insulator 28 toward the component side 32 to facilitate engagement between the alignment tails 72 and the insulator 28 within the alignment holes 70.

In an alternative embodiment, the tips 74 of the alignment tails 72 do not engage the solder balls 80. Rather, the alignment holes 70 are electrically conductive vias. The alignment tails 72 and the solder balls 80 are engaged with the conductive materials of the alignment holes 70 such that the conductive materials of the alignment holes 70 electrically connect the alignment tails 72 to the solder balls 80. In yet another alternative embodiment, electrically conductive vias (not shown) extend through the insulator 28 from the solder pads 64 to the component side 32 of the insulator 28. The solder balls 80 are engaged with the conductive vias. The conductive vias electrically connect the solder pads 64, and thus the mounting bases 36, on the module side 30 of the insulator 28 to the solder balls 80 on the component side 32. It should be appreciated that in alternative embodiments wherein the alignment holes 70 are not used to electrically connect the electrical contacts 22 to the solder balls 80, the alignment holes 70 may not extend completely through the insulator 28.

Figure 9:
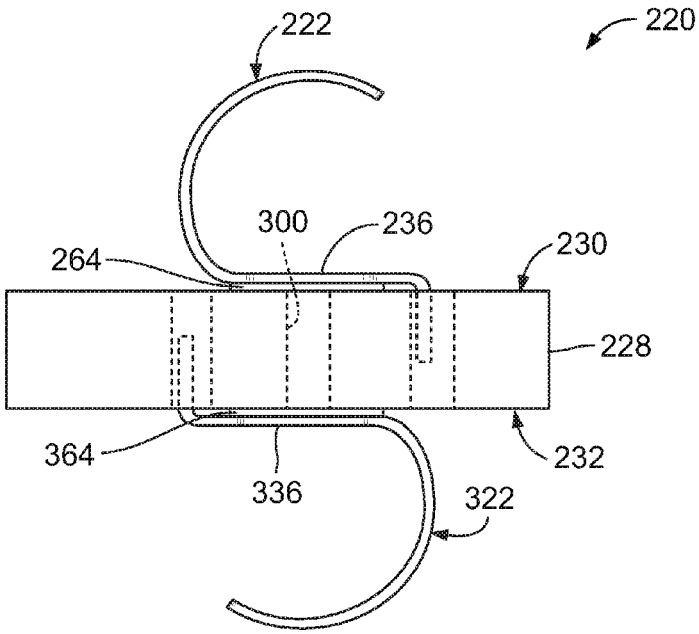
FIG. 9 is a side elevational view of a portion of an exemplary alternative embodiment of an interconnect member illustrating electrical contacts mounted on both sides of an insulator.

FIG. 9 is a side elevational view of a portion of an exemplary alternative embodiment of an interconnect member 220. Rather than using the solder balls 80 (FIG. 8), the interconnect member 220 includes electrical contacts 322 on a component side 232 of the interconnect member 220. The interconnect member 220 includes an insulator 228 having a module side 230 and the component side 232. Electrical contacts 222 are mounted on the module side 230 for engagement with the contact pads (not shown) on the mating side 24 (FIG. 1) of the electronic module 16 (FIG. 1). The electrical contacts 322 are mounted on the component side 232 of the insulator 228 for engagement with the contact pads (not shown) of the printed circuit 14 (FIG. 1). Each of the electrical contacts 222 may be referred to herein as a "first" and/or a "second" electrical contact. Each of the electrical contacts 322 may be referred to herein as a "third" electrical contact.

The electrical contacts 222 and 322 include respective mounting bases 236 and 336. The mounting bases 236 and 336 are mechanically and electrically connected to respective solder pads 264 and 364 on the module and component sides 230 and 232, respectively, of the insulator 228. Electrically conductive vias 300 extend through the insulator 228 from the solder pads 264 to the solder pads 364. The vias 300 electrically connect each solder pad 264 on the module side 230 of the insulator 228 to a corresponding solder pad 364 on the component side 232 of the insulator 228. Accordingly, each conductive via 300 electrically connects a corresponding electrical contact 222 on the module side 230 with a corresponding electrical contact 322 on the component side 232 of the insulator 228.

Similar to the electrical contacts 22 (FIGS. 1-3, 5, 7 and 8), adjacent electrical contacts 222 are initially mechanically and electrically connected together via connection strips (not shown). Adjacent electrical contacts 322 are also initially mechanically and electrically connected together via connection strips (not shown). It should be appreciated that a single punch opening (not shown) may be aligned with both a connection strip that interconnects two adjacent electrical contacts 222 and another connection strip that interconnects the corresponding adjacent electrical contacts 322. In other words, a single punch opening may allow a single tool to break both a connection strip extending along the module side 230 of the insulator 228 and another connection strip extending along the component side 232 of the insulator 228. The end 48 (FIG. 5) of the punch tool 46 (FIG. 5) may first be used to break the connection strip on the module side 230 of the insulator 228 and thereafter inserted through the punch opening to break the connection strip on the component side 232 of the insulator 228, or vice versa.

Figure 10:
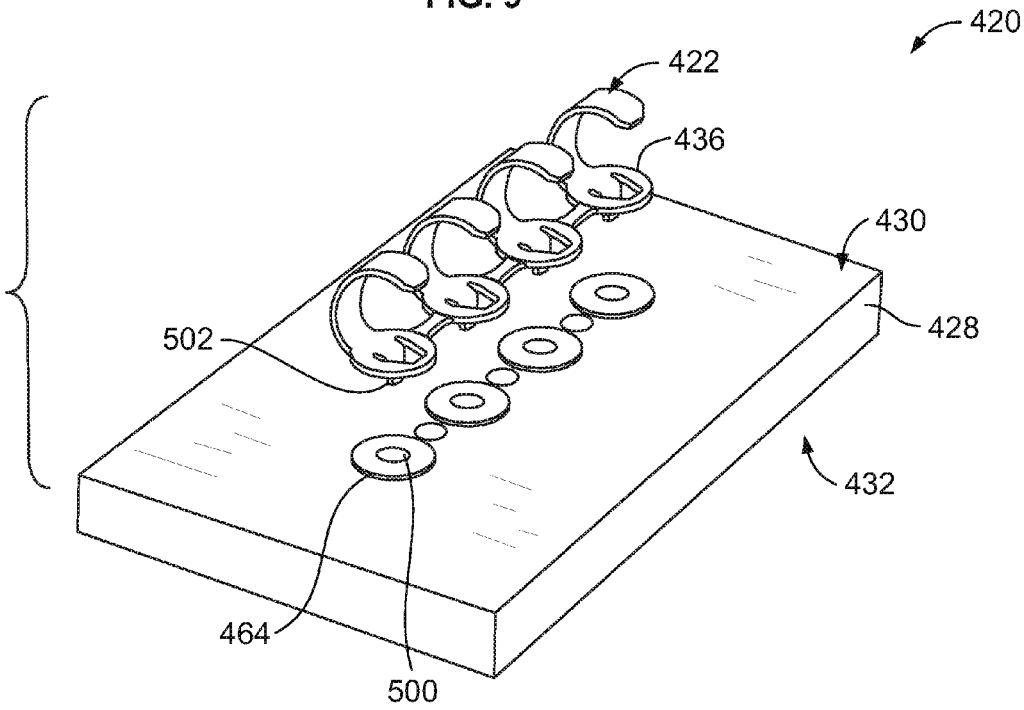
FIG. 10 is an exploded perspective view of a portion of another exemplary alternative embodiment of an interconnect member.

FIG. 10 is an exploded perspective view of a portion of another exemplary alternative embodiment of an interconnect member 420. The interconnect member 420 includes an insulator 428 having a module side 430 and a component side 432. Electrical contacts 422 are mounted on the module side 430 for engagement with the contact pads (not shown) on the mating side 24 (FIG. 1) of the electronic module 16 (FIG. 1). The electrical contacts 422 include mounting bases 436 that are mechanically connected to solder pads 464 on the module side 430 of the insulator 428. Electrically conductive vias 500 extend through the solder pads 464 and the insulator 428. Each of the electrical contacts 422 may be referred to herein as a "first" and/or a "second" electrical contact.

In addition or alternative to being mechanically connected to the solder pads 464 using solder and/or adhesive, the mounting bases 464 include retention barbs 502 that extend into the conductive vias 500. The retention barbs 502 engage the conductive vias 500 with an interference fit to mechanically connect the electrical contacts 422 to the insulator 428. Electrical connection of the electrical contacts 422 to the conductive vias 500 may be provided by engagement of the mounting bases 436 with the solder pads 464, a solder and/or adhesive connection between the mounting bases 436 and the solder pads 464, and/or engagement of the retention barbs 502 with the conductive vias 500. Reception of the retention barbs 502 within the conductive vias 500 positions the mounting bases 436 relative to the solder pads 464.

Figure 12:
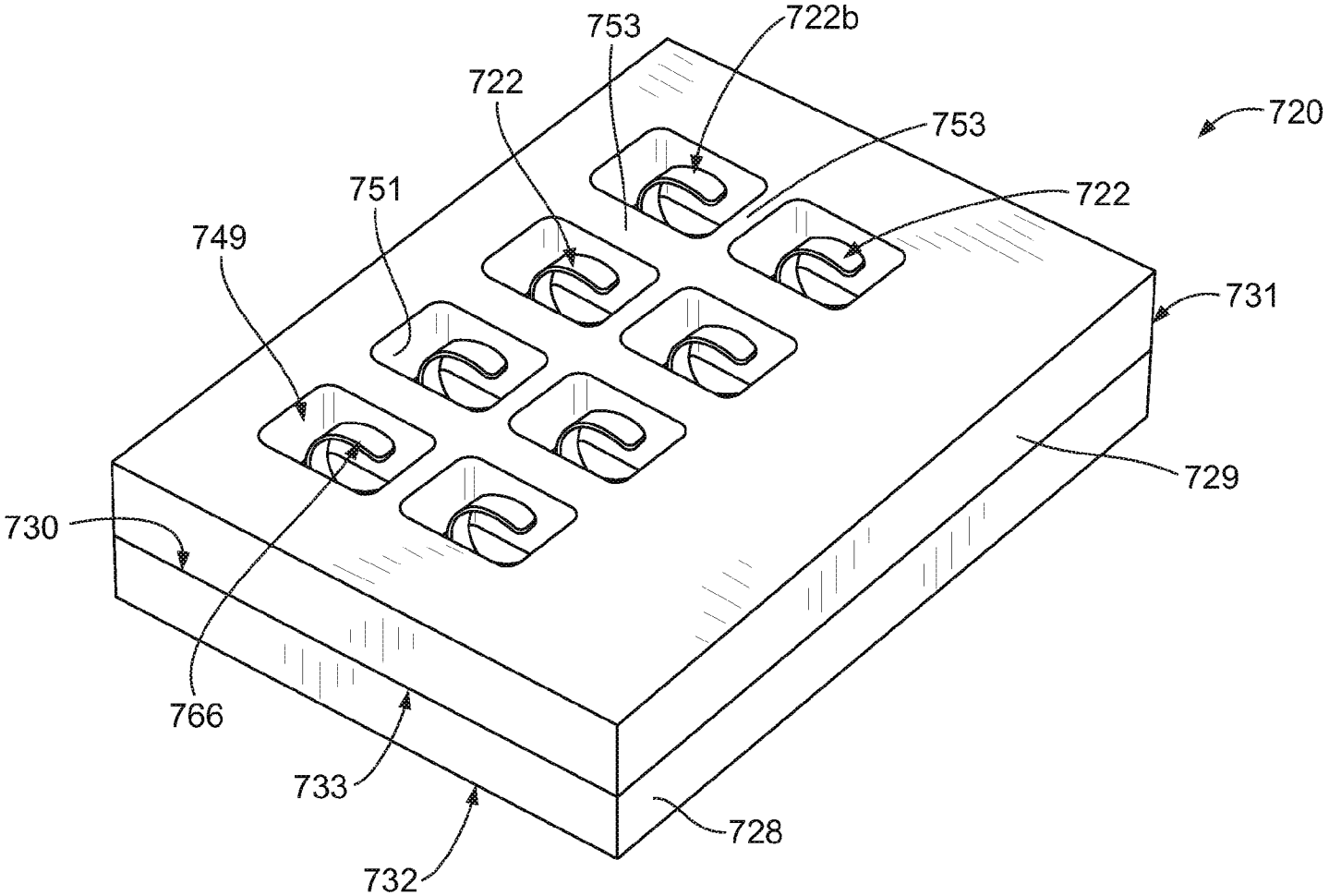
FIG. 12 is a perspective view of another exemplary alternative embodiment of an interconnect member.
Figure 13:
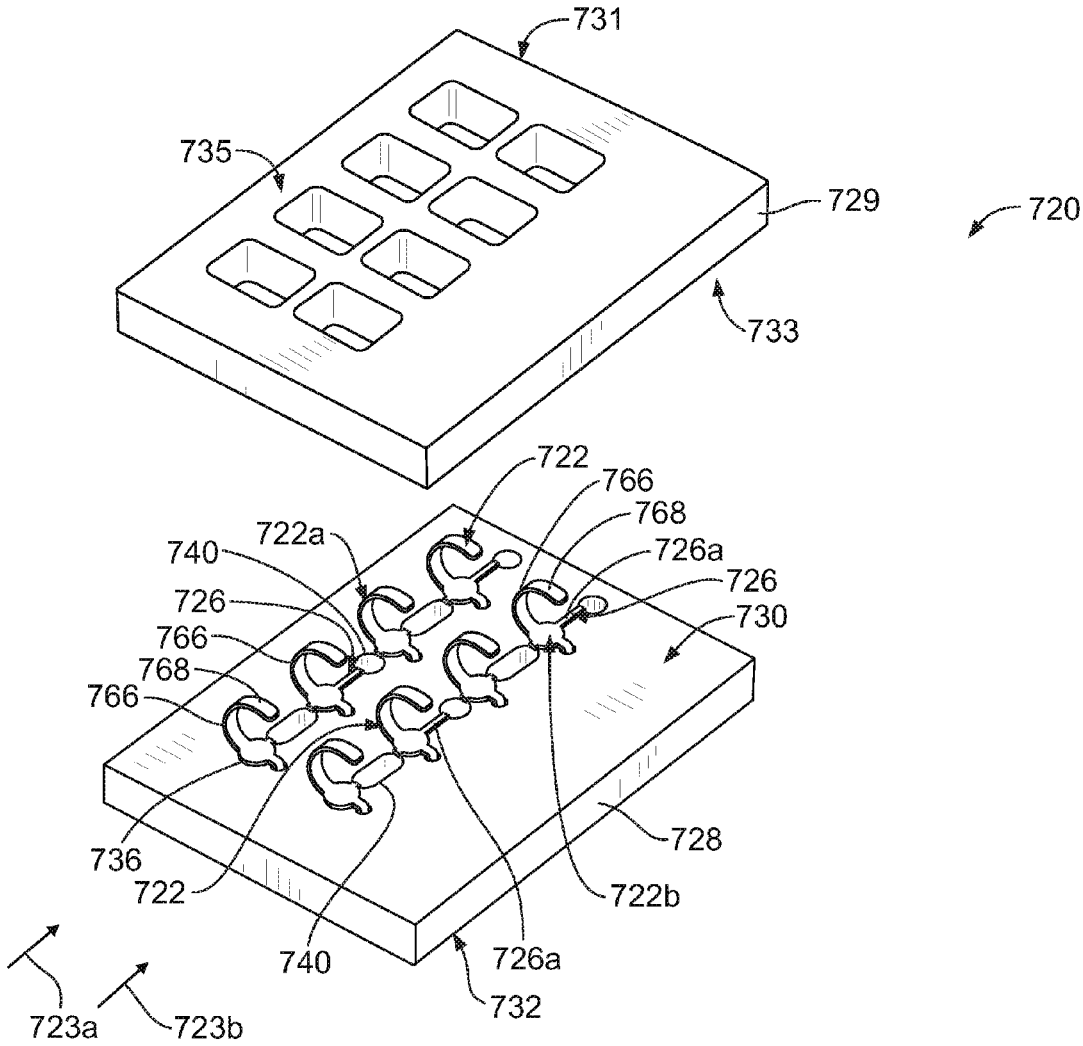
FIG. 13 is a partially exploded perspective view of the interconnect member shown in FIG. 12.

FIG. 12 is a perspective view of another exemplary alternative embodiment of an interconnect member 720. FIG. 13 is a partially exploded perspective view of the interconnect member 720. Referring now to FIGS. 12 and 13, the interconnect member 720 includes an insulator 728, an array of electrical contacts 722 held by the insulator 728, and a shield 729 mounted on the insulator 728. The insulator 728 includes a module side 730 and an opposite component side 732. When the interconnect member 720 electrically connects the electronic module 16 (FIG. 1) to the printed circuit 14 (FIG. 1), the insulator 728 extends between the electronic module 16 and the printed circuit 14 such that the module side 730 faces the electronic module 16 and the component side 732 faces the printed circuit 14. The module side 730 and the component side 732 of the insulator 728 are each optionally approximately planar. Each of the electrical contacts 722 may be referred to herein as a "first" and/or a "second" electrical contact.

Referring now solely to FIG. 13, the electrical contacts 722 include mounting bases 736 that are mechanically connected to the insulator 728 on the module side 730. Each electrical contact 722 includes a mating segment 766 that extends outwardly from the mounting base 736. The mating segments 766 include mating interfaces 768 that are configured to engage the corresponding contact pads (not shown) on the mating side 24 (FIG. 1) of the electronic module 16 (FIG. 1) to electrically connect the electrical contacts 722 to the electronic module 16. Optionally, the mating segments 766 are resiliently deflectable springs that are configured to deflect toward the insulator 728 when engaged with the contact pads of the electronic module 16. In addition or alternative to being resiliently deflectable springs, an elastomeric column (not shown) is optionally disposed between the mounting base 736 and the mating segment 766 of one or more of the electrical contacts 722. The mating segments 766 are shown herein including a curved shape that curls back over the mounting bases 736. But, the mating segments 766 may additionally or alternatively include any other shape.

The electrical contacts 722 include signal contacts 722*a* and ground contacts 722*b*. The mating interfaces 768 of the signal contacts 722*a* engage signal pads (not shown) of the contact pads on the mating side 24 of the electronic module 16. The mating interfaces 768 of the ground contacts 722*b* engage ground pads (not shown) of the contact pads on the mating side 24 of the electronic module 16. In the exemplary embodiment, the electrical contacts 722 are shown as including four signal contacts 722*a* and four ground contacts 722*b*. But, the electrical contacts 722 may include any number of the signal contacts 722*a* and may include any number of the ground contacts 722*b*. Moreover, the electrical contacts 722 may include any number of the signal contact 722*a* relative to the number of ground contacts 722*b*. In some embodiments, the electrical contacts 722 include less ground contacts 722*b* than signal contacts 722*a*.

In the exemplary embodiment, the electrical contacts 722 are arranged in two rows 723*a* and 723*b* that each includes two of the signal contacts 722*a* and two of the ground contacts 722*b*. Moreover, the signal contacts 722*a* within the row 723*a* are aligned with the signal contacts 722*a* within the row 723*b*, and the ground contacts 722*b* within the row 723*a* are aligned with the ground contacts 722*b* within the row 723*b*. However, any of the electrical contacts 722 may be selected as signal contacts 722*a* and any of the electrical contacts 722 may be selected as ground contacts 722*b*. Moreover, the array of electrical contacts 722 may have any other pattern, relative arrangement, and/or the like of the signal contacts 722*a* and the ground contacts 722*b*. It should be understood that only a portion of the array of electrical contacts 722 may be shown herein. In other words, only some of the electrical contacts 722 of the interconnect member 720 may be shown. The array of electrical contacts 722 may include other electrical contacts 722 that are not shown and the array of electrical contacts 722 may include other rows and/or columns.

The mounting bases 736 of at least some adjacent electrical contacts 722 are initially mechanically and electrically connected together via connection strip 726. As can be seen in FIG. 13, the connection strips 726 have been broken and removed, for example using punch openings 740, such that the mounting bases 736 of the electrical contacts 722 are no longer mechanically and electrically connected together. Accordingly, the electrical contacts 722 within the array are electrically isolated from each other. The connection strips 726 are broken such that a remainder segment 726*a* of at least one connection strip 726 that extends from each ground contact 722*b* is left over, or remains, after the connection strip 726 has been broken. As will be described below, the remainder segments 726*a* engage the shield 729 to electrically connect the ground contacts 722*b* to the shield 729.

Whether or not a remainder segment 726*a* remains after a connection strip 726 has been broken may depend on a size of the corresponding punch opening 740. For example, as can be seen in FIG. 13, the punch openings 740 that enable the connection strips 726 to be broken while leaving the remainder segments 726*a* are smaller than the punch openings 740 that enable the connection strips 726 to be broken without leaving a remainder segment 726*a*. Each segment 726*a* may be referred to herein as a "remainder" and/or as a "shorting tab".

The shield 729 includes a body 731 that is at last partially electrically conductive. The body 731 includes an insulator side 733 and a side 735 that is opposite the insulator side 733. The body 731 is configured to be mounted on the insulator 728 such that the body 731 covers at least a portion of the module side 730 of the insulator 728. As should be apparent from FIG. 12, when the body 731 of the shield 729 is mounted on the insulator 728, the insulator side 733 of the body 731 faces the module side 730 of the insulator 728. Optionally, the insulator side 733 of the body 731 engages the module side 730 of the insulator 728 when the body 731 is mounted on the insulator 728.

Figure 14:
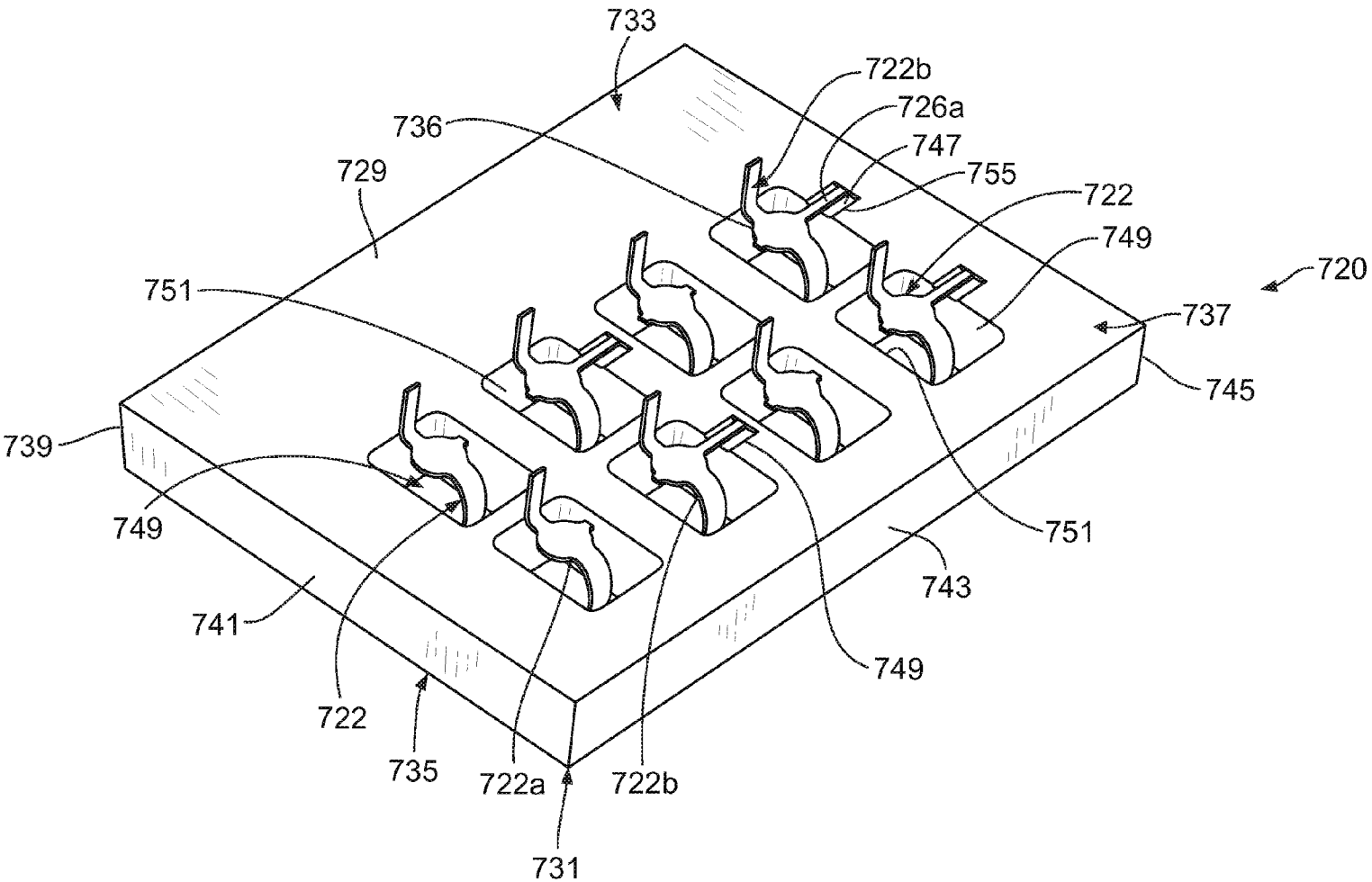
FIG. 14 is a perspective view of a portion of the interconnect member shown in FIGS. 12 and 13.

FIG. 14 is a perspective view of a portion of the interconnect member 720 illustrating the body 731 of the shield 729 in an inverted orientation relative to the orientation shown in FIGS. 12 and 13. FIG. 14 also illustrates the arrangement of the electrical contacts 722 relative to the shield body 731 when the body 731 is mounted on the insulator 728 (FIGS. 12 and 13), as will be described below. The body 731 may include any shape that enables the body 731 to shield the electrical contacts 722. In the exemplary embodiment, the body 731 of the shield 729 is a sheet of material that extends over at least a portion of the module side 730 (FIGS. 12 and 13) of the insulator 728. The body 731 has an overall block-shape in the exemplary embodiment. For example, the body 731 has the overall shape of a parallelepiped. But, the body 731 of the shield 729 may additionally or alternatively include any other overall shape, such as, but not limited to, a cylindrical shape, an oval shape, any other non-parallelepiped shape, and/or the like. Optionally, the insulator side 733 and/or the side 735 are approximately planar. In the exemplary embodiment, the insulator side 733 and the side 735 are each approximately planar sides that extend approximately parallel to each other. The shield body 731 may have any size, including any thickness defined between the insulator side 733 and the side 735. In some embodiments, the thickness and/or another dimension of the body 731 of the shield 729 is selected to provide the body 731 with a predetermined amount of electrical conductivity and/or with a predetermined amount of shielding.

Optionally, an anodization layer 737 extends over at least a portion of the shield body 731. The anodization layer 737 may extend over any sides, portion, amount, segments, and/or the like of the body 731. In the exemplary embodiment, the anodization layer 737 extends over an entirety of the side 735 and an entirety of each side 739, 741, 743, and 745 that extends between and interconnects the insulator side 733 and the side 735. The anodization layer 737 also extends over a portion of the insulator side 733 of the body 731 in the exemplary embodiment. Optionally, segments 747 of the body 731 are exposed through holes 755 within the anodization layer 737. As will be described below, the remainder segments 726*a* of the ground contacts 722*b* engage the body 731 of the shield 729 through the holes 755 to electrically connect the ground contacts 722*b* to the shield body 731.

In the exemplary embodiment, the body 731 of the shield 729 includes a plurality of openings 749 that extend through the sides 733 and 735 and completely through the body 731 therebetween. As will be described below, each opening 749 receives one or more electrical contacts 722 therein when the shield body 731 is mounted on the insulator 728. Each opening 749 is defined by at least one interior wall 751 of the body 731. For example, in the exemplary embodiment, each opening is defined by four interior walls 751 that are interconnected at, optionally, rounded corners. The four interior walls 751 define an opening 749 having a parallelepiped shape in the exemplary embodiment. However, each opening 749 may additionally or alternatively include any other shape for receiving electrical contact(s) 722 that include any shape. Moreover, each opening may be defined by any number of interior walls 751.

Referring again to FIG. 12, when the shield body 731 is mounted on the insulator 728, the openings 749 receive the electrical contacts 722 therein. Specifically, in the exemplary embodiment, the mating segment 766 of each electrical contact 722 is received within a corresponding one of the openings 749 such that the interior walls 751 of the opening 749 extend around the mating segment 766. The body 731 of the shield 729 includes segments 753 that extend between adjacent electrical contacts 722 within the array. In the exemplary embodiment, each opening 749 receives a single one of the electrical contacts 722 therein. But, each opening 749 may receive any number of the electrical contacts 722 therein. For example, in some alternative embodiments, one or more of the openings 749 receives a differential signal pair of the electrical contacts 722 therein. In still other alternative embodiments, one or more of the openings 749 receives a group of more than two electrical contacts 722 therein. Although eight are shown, the shield 729 may include any number of openings 749 for any number of electrical contacts 722.

When the shield 729 is mounted on the insulator 728 as shown in FIG. 12, the body 731 of the shield 729 is engaged with the ground contacts 722*b* such that the shield body 731 is electrically connected to the ground contacts 722*b*. More specifically, and referring again to FIG. 14, when the electrical contacts 722 are received within the openings 749 of the shield 729, the remainder segments 726*a* of the ground contacts 722*b* extend outwardly from the mounting bases 736 along the insulator side 733 of the body 731. Each remainder segment 726*a* engages the insulator side 733 of the shield body 731 to electrically connect the corresponding ground contact 722*b* to the shield body 731. Specifically, in the exemplary embodiment, the remainder segments 726*a* of the ground contacts 722*b* engage the segments 747 of the insulator side 733 of the shield body 731 through the holes 755 within the anodization layer 737 to electrically connect the ground contacts 722*b* to the shield body 731.

Referring again to FIG. 12, when the body 731 of the shield 729 is electrically connected to the ground contacts 722*b*, the shield body 731 shields the electrical contacts 722 from each other. For example, the interior walls 751 that define the openings 749 of the shield body 731 form shielding walls that extend around the corresponding electrical contacts 722 and between adjacent electrical contacts 722 within the array. As can be seen in FIG. 12, the segments 753 form shielding segments that the extend between adjacent electrical contacts 722 within the array. The walls 751 and the segments 753 thereby shield adjacent electrical contacts 722 from each other. In alternative embodiments wherein one or more openings 749 receives a differential pair of electrical contacts 722 therein, the walls 751 and the segments 753 shield the differential pair(s) of electrical contacts 722 from adjacent individual contacts 722, from adjacent differential pair(s) of contacts 722, and/or from adjacent groups of more than two of the contacts 722. Similarly, in alternative embodiments wherein one or more openings 749 receives a group of more than two electrical contacts 722 therein, the walls 751 and the segments 753 shield the group of electrical contacts 722 from adjacent individual contacts 722, from adjacent differential pair(s) of contacts 722, and/or from adjacent groups of more than two of the contacts 722.

Figure 15:
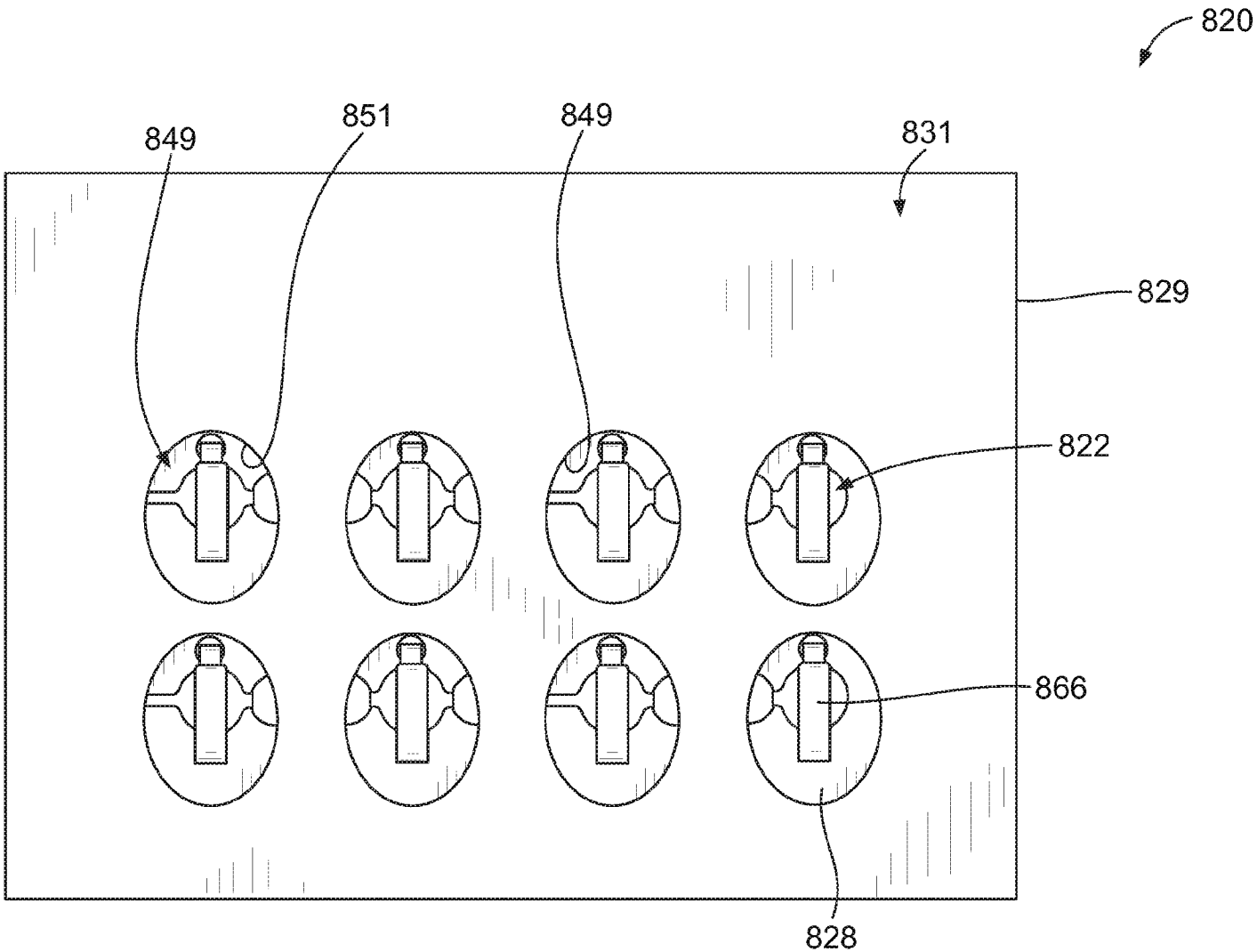
FIG. 15 is a top plan view of another exemplary alternative embodiment of an interconnect member.

FIG. 15 is a top plan view of another exemplary alternative embodiment of an interconnect member 820. FIG. 15 illustrates an interconnect member 820 that includes a shield 829 having one example of differently shaped openings 849 than the openings 749 (FIGS. 12 and 14) of the shield 729 (FIGS. 12-14). The interconnect member 820 includes an insulator 828, an array of electrical contacts 822 held by the insulator 828, and a shield 829 mounted on the insulator 828. Each electrical contact 822 includes a mating segment 866 that is configured to engage the corresponding contact pad (not shown) on the mating side 24 (FIG. 1) of the electronic module 16 (FIG. 1) to electrically connect the electrical contacts 822 to the electronic module 16. Each of the electrical contacts 822 may be referred to herein as a "first" and/or a "second" electrical contact.

The shield 829 includes an at least partially electrically conductive body 831. The body 831 of the shield 829 includes a plurality of openings 849 that extend through the body 831. Each opening 849 receives one or more electrical contacts 822 therein when the shield body 831 is mounted on the insulator 828. In the exemplary embodiment, each opening 849 is defined by a single interior wall 851 of the body 831. The interior wall 851 is shaped such that the wall 851 defines an opening 849 having an oval-shape.

The embodiments described and/or illustrated herein may provide an electrical connector that has less ground contacts than at least some known electrical connectors for a given-sized connector and/or for an array having a given number of electrical contacts overall. The embodiments described and/or illustrated herein may provide an electrical connector that has more signal contacts than at least some known electrical connectors for a given-sized connector and/or for an array having a given number of electrical contacts overall. The embodiments described and/or illustrated herein may provide an electrical connector that has a higher density of signal contacts than at least some known electrical connectors for a given-sized connector and/or for an array having a given number of electrical contacts overall. The embodiments described and/or illustrated herein may provide an electrical connector having a greater flexibility of the relative arrangement of signal contacts, ground contacts, and/or signal contact pairs within an array of electrical contacts than at least some known electrical connectors. The embodiments described and/or illustrated herein may provide an electrical connector wherein a ground contact does not need to be adjacent a signal contact or between two adjacent signal contacts. The embodiments described and/or illustrated herein may provide an electrical connector that is easier to assemble, less expensive to assemble, and/or takes less time to assemble than at least some known electrical connectors.

As used herein, the term "printed circuit" is intended to mean any electric circuit in which the conducting connections have been printed or otherwise deposited in predetermined patterns on an electrically insulating substrate. A substrate of the printed circuit 14 may be a flexible substrate or a rigid substrate. The substrate may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate is a rigid substrate fabricated from epoxy-glass, such that the printed circuit 14 is what is sometimes referred to as a "circuit board" or a "printed circuit board".

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for electrically connecting an electronic module to an electrical component, said electrical connector comprising:

an insulator having a module side and an opposite component side, the insulator being configured to extend between the electronic module and the electrical component such that the module side faces the electronic module and the component side faces the electrical component;

electrical contacts held by the insulator, the electrical contacts comprising mating segments arranged in an array along the module side of the insulator, the mating segments being configured to mate with mating contacts of the electronic module; and a shield comprising a body that is at least partially electrically conductive, the body of the shield being mounted on the insulator such that the body covers at least a portion of the module side of the insulator, the body of the shield comprising an opening defined by at least one interior wall of the body, the opening receiving the mating segment of at least one of the electrical contacts therein such that the at least one interior wall extends at least partially around the mating segment of the at least one electrical contact.

2. The electrical connector of claim 1, wherein the body of the shield comprises a plurality of the openings each defined by at least one corresponding interior wall of the body, each opening receiving the mating segment of at least one corresponding electrical contact therein such that the at least one corresponding interior wall extends at least partially around the mating segment of the at least one corresponding electrical contact.

3. The electrical connector of claim 1, wherein the electrical contacts comprise a ground contact, the body of the shield being engaged with the ground contact to electrically connect the body to the ground contact.

4. The electrical connector of claim 1, wherein the body of the shield comprises an insulator side that faces the module side of the insulator, the electrical contacts comprising a ground contact having a shorting tab, the insulator side of the body being engaged with the shorting tab of the ground contact to electrically connect the body to the ground contact.

5. The electrical connector of claim 1, wherein the body of the shield comprises an insulator side that faces the module side of the insulator, an anodization layer extending on the insulator side of the body, a segment of the insulator side of the body being exposed through a hole within the anodization layer, the electrical contacts comprising a ground contact having a shorting tab, the shorting tab being engaged with the insulator side of the body through the hole within the anodization layer to electrically connect the body to the ground contact.

6. The electrical connector of claim 1, wherein the electrical contacts comprise mounting bases that are initially mechanically connected together by connection strips, each connection strip extending along a connection path from the mounting base of one of electrical contacts to the mounting base of another of the electrical contacts, the connection strip being broken along the connection path such that the electrical contacts are separated from each other, wherein the electrical contacts comprise a ground contact and a remainder of the connection strip of the ground contact forms a shorting tab that is engaged with the body of the shield to electrically connect the body to the ground contact.

7. The electrical connector of claim 1, wherein the electrical contacts comprise mounting bases that are initially mechanically connected together by connection strips, each connection strip extending along a connection path from the mounting base of one of the electrical contacts to the mounting base of another of the electrical contacts, the connection strip being broken along the connection path such that the electrical contacts are separated from each other, the electrical contacts comprising a ground contact, a remainder of the connection strip of the ground contact forming a shorting tab that is engaged with the body of the shield to electrically connect the body to the ground contact, the insulator comprising punch openings extending into the module side of the insulator, wherein the punch openings are aligned with the connection paths of corresponding connection strips and are configured to receive a punch tool for breaking the connection strips.

8. The electrical connector of claim 1, wherein the body of the shield comprises a segment that extends between adjacent electrical contacts within the array.

9. The electrical connector of claim 1, wherein the body of the shield comprises at least one of a sheet of material that extends over at least a portion of the module side of the insulator or a block-shape.

10. The electrical connector of claim 1, wherein the body of the shield comprises an insulator side and an opposite side, the insulator side facing the module side of the insulator, the insulator and opposite sides of the body of the shield being approximately planar.

11. The electrical connector of claim 1, wherein the body of the shield comprises an insulator side that is engaged with the module side of the insulator.

12. The electrical connector of claim 1, further comprising a socket that is configured to receive at least a portion of the electronic module therein.

13. The electrical connector of claim 1, wherein the module and component sides of the insulator are approximately planar.

14. The electrical connector of claim 1, wherein the opening is a first opening and the body of the shield comprises a second opening having at least one interior wall that extends at least partially around the mating segment of at least one corresponding electrical contact, the body further comprising a segment that is a generally solid block of electrically conductive material that extends from the first opening to the second opening.

15. An electrical connector for electrically connecting an electronic module to an electrical component, said electrical connector comprising:

an insulator having a module side and a component side that is opposite the module side;

electrical contacts held by the insulator, the electrical contacts comprising mating segments arranged in an array along the module side of the insulator, the mating segments being configured to mate with mating contacts of the electronic module, the electrical contacts comprising a ground contact; and a shield comprising a body that is at least partially electrically conductive, the body of the shield being mounted on the insulator such that the body extends at least partially around the mating segment of at least one of the electrical contacts, the body of the shield being engaged with the ground contact to electrically connect the body to the ground contact.

16. The electrical connector of claim 15, wherein the body of the shield comprises an insulator side that faces the module side of the insulator, the ground contact comprising a shorting tab, the insulator side of the body being engaged with the shorting tab of the ground contact to electrically connect the body to the ground contact.

17. The electrical connector of claim 15, wherein the body of the shield comprises an insulator side that faces the module side of the insulator, an anodization layer extending on the insulator side of the body, a segment of the insulator side of the body being exposed through a hole within the anodization layer, the ground contact having a shorting tab, the shorting tab being engaged with the insulator side of the body through the hole within the anodization layer to electrically connect the body to the ground contact.

18. The electrical connector of claim 15, wherein the electrical contacts comprise mounting bases that are initially mechanically connected together by connection strips, each connection strip extending along a connection path from the mounting base of one of the electrical contacts to the mounting base of another of the electrical contacts, the connection strip being broken along the connection path such that the electrical contacts are separated from each other, wherein a remainder of the connection strip of the ground contact forms a shorting tab that is engaged with the body of the shield to electrically connect the body to the ground contact.

19. The electrical connector of claim 15, wherein the body of the shield comprises at least one of a sheet of material that extends over at least a portion of the module side of the insulator or a block-shape.

20. The electrical connector of claim 15, wherein the body of the shield comprises a segment that extends between adjacent electrical contacts within the array.

21. An electronic assembly comprising:

an electronic module comprising an array of mating contacts;

an electrical component; and an electrical connector extending between and electrically connecting the electronic module to the electrical component, said electrical connector comprising:

an insulator having a module side and an opposite component side, the module side facing the electronic module and the component side facing the electrical component, the electrical connector being electrically connected to the electrical component along the component side of the insulator;

electrical contacts held by the insulator, the electrical contacts comprising mating segments arranged in an array along the module side of the insulator, the mating segments being mated with the mating contacts of the electronic module; and a shield comprising a body that is at least partially electrically conductive, the body of the shield being mounted on the insulator such that the body extends at least partially around the mating segment of at least one of the electrical contacts.

* * * * *